United States Patent [19]

Takahashi et al.

[11] Patent Number: 4,580,956

[45] Date of Patent: Apr. 8, 1986

[54] BIASED DRIVE MECHANISM FOR AN ORBITING FLUID DISPLACEMENT MEMBER

[75] Inventors: Kazunari Takahashi, Nita; Masaharu Hiraga, Honjo, both of Japan

[73] Assignee: Sanden Corporation, Gunma, Japan

[21] Appl. No.: 713,100

[22] Filed: Mar. 18, 1985

Related U.S. Application Data

[63] Continuation of Ser. No. 435,241, Oct. 19, 1982, abandoned.

[30] Foreign Application Priority Data

Oct. 20, 1981 [JP] Japan ..... 56-168320

[51] Int. Cl.[4] ..... F01C 1/04; F01C 17/06; F01C 21/00

[52] U.S. Cl. ..... 418/14; 418/55; 418/57; 418/151

[58] Field of Search ..... 418/14, 55, 57, 59, 418/151

[56] References Cited

U.S. PATENT DOCUMENTS

| | | | |
|---|---|---|---|
| 1,906,142 | 4/1933 | Ekelof | 418/57 |
| 3,874,827 | 4/1975 | Young | 418/151 |
| 3,924,977 | 12/1975 | McCullough | 418/57 |
| 4,383,805 | 5/1983 | Teegarden et al. | 418/55 |

FOREIGN PATENT DOCUMENTS

| | | | |
|---|---|---|---|
| 55-60684 | 5/1980 | Japan | 418/14 |

*Primary Examiner*—John J. Vrablik

*Attorney, Agent, or Firm*—Banner, Birch, McKie & Beckett

[57] ABSTRACT

A fluid displacement apparatus is disclosed. The fluid displacement apparatus includes a housing, a fixed fluid displacement member and an orbiting fluid displacement member having an end plate from which an orbiting wall extends. The orbiting member interfits with the fixed member to make a plurality of line contacts to define at least one sealed-off fluid pocket. A drive shaft is rotatably supported by the housing, and has a drive pin which is radially offset from the axis of the drive shaft. The end plate of orbiting piston member has a boss, and bushing is rotatably supported within the boss. The bushing has an eccentric hole disposed eccentrically with respect to the center of the bushing, and the drive pin is inserted in the eccentric hole. A restriction device restricts the swing angle of the bushing and is coupled between the drive shaft and the bushing. The restriction device includes a spring to push the orbiting fluid displacement member in the direction to reduce the orbital radius of the orbiting member. The line contacts between fixed member and orbiting member are thereby separated until the orbiting member reaches a predetermined desired rotational frequency. The compressor thus starts up in an unloaded condition.

6 Claims, 14 Drawing Figures

BIASED DRIVE MECHANISM FOR AN ORBITING FLUID DISPLACEMENT MEMBER

This application is a continuation of application Ser. No. 435,241, filed Oct. 19, 1982, now abandoned.

BACKGROUND OF THE INVENTION

This invention relates to a fluid displacement apparatus, and particularly to a fluid compressor or pump unit of the type which utilizes an orbiting fluid displacement member.

There are several types of fluid displacement apparatus which utilize an orbiting fluid displacement member driven by a Scotch yoke type shaft coupled to an end surface of the orbiting fluid displacement member. U.S. Pat. No. 1,906,142 to John Ekelof discloses a rotary fluid displacement apparatus provided with an annular, eccentrically movable piston or wall adapted to act within an annular cylinder with a fixed radial transverse wall. One end of the chamber defined by the movable piston and annular cylinder is the wall of the cylinder, and the other wall of the chamber consists of a cover disc connected to the annular piston. The annular piston is driven by a crank shaft. Other prior art fluid displacement apparatus are shown in U.S. Pat. Nos. 801,182 and 3,560,119.

Though the present invention applies to either type of fluid displacement apparatus; i.e., using either an annular-shaped fluid displacement wall or a scroll (spiroidal) shaped fluid displacement wall, the description or orbiting fluid displacement member will be limited to a scroll-type compressor. The term "orbiting fluid displacement member" is used to generally describe a movable fluid displacement member of any suitable configuration in fluid displacement apparatus; i.e., annular piston, scroll, etc.

U.S. Pat. No. 801,182 discloses a fluid displacement device including two scroll members each having an end plate and a spiroidal or involute spiral element. These scroll members are maintained angularly and radially offset so that both spiral elements interfit to make a plurality of line contacts between the spiral curved surfaces to thereby seal off and define at least one pair of fluid pockets. The relative orbital motion of the two scroll members shifts the line contacts along the spiral curved surfaces, and therefore, the fluid pockets change in volume. The volume of the fluid pockets increases or decreases dependent on the direction of the orbital motion. Therefore, a scroll-type fluid displacement apparatus can be used to compress, expand or pump fluids.

Scroll-type fluid displacement apparatus can be used as refrigerant compressors in refrigerators or air conditioners. Such compressors need a driving power source; for example, the motor of an engine, to drive the compressor. The compressor generally expends the greatest driving power during start-up. Therefore, if the compressor is connected to the driving power source, the output of which is matched with the average power of the driving compressor, satisfactory power to start up the compressor would not be obtained.

One solution to avoid this disadvantage is to use a motor or engine with larger output power. However, the outer dimension or weight of the driving power source would increase so that the cost of the power source increases. Furthermore, the greatest electric current is expent to start up the motor or the starter for the engine.

Another construction used to avoid this disadvantage is a magnetic valve device which selectively connects the compressor's discharge line with its suction line. In this construction, the magnetic valve device opens a connecting passageway before the drive of the compressor stops so that discharge gas flows into the suction side through the passageway of the magnetic valve device. The next time the compressor is started, the compressor is driven through a stage or time period when the pressure in the suction and discharge chambers is balanced. Therefore, the temporary expenditure of a large amount of power during start-up of the compressor is prevented. However, this construction requires a control circuit to operate the magnetic valve device which has the disadvantage of being complicated and increasing the cost of the apparatus. Furthermore, if the sealing of the discharge valve of the compressor, which is provided with the magnetic valve device, deteriorates, the pressure of the suction and discharge chamber may balance at undesirable times because of flow back through the discharge valve.

SUMMARY OF THE INVENTION

It is a primary object of this invention to provide an improvement in a fluid displacement apparatus which makes starting of the apparatus easier.

It is another object of this invention to provide a fluid displacement apparatus which is reliable at relatively low cost.

A fluid displacement apparatus according to this invention includes a housing having a fluid inlet port and a fluid outlet port. A fixed fluid displacement member is fixedly disposed relative to the housing, and accepts and cooperates with an oriting fluid displacement member to compress or pump fluid. The orbiting member is driven by a drive shaft which penetrates the housing and is rotatably supported thereby through a bearing. An eccentric bushing, which is fitted within the orbiting member, is swingably connected to an axial end of the drive shaft. A swing angle limiting device is located between the drive shaft and the bushing and restricts the angle of the arc through which the bushing can swing. The swing angle limiting device includes a spring which pushes the orbiting member in a direction to reduce the radius of orbital motion of the orbiting member, whereby the compressor starts in an unloaded condition; i.e., with no compression occurring at start-up.

In one embodiment of this invention the housing has a fluid inlet port and a fluid outlet port and a fixed scroll is fixedly disposed relative to the housing and includes a circular end plate from which a first wrap extends. An orbiting scroll also has a circular end plate from which a second wrap extends. The first and second wraps interfit at an angular and radial offset to make a plurality of line contacts to define at least a pair of sealed-off fluid pockets.

A driving mechanism, including a drive shaft which penetrates the housing and is rotatably supported thereby, effects the orbital motion of the orbiting scroll by the rotation of the drive shaft. The rotation of the orbiting scroll is prevented during its orbital motion. The fluid pockets change volume because of the orbital motion of the orbiting scroll. A drive pin is eccentrically located at the inner end of the drive shaft and is connected to the orbiting scroll through a bushing, which is held within a boss projecting axially from an end surface of the orbiting scroll's end plate. The swing angle limiting device includes a pin projecting from the end surface of the bushing, a reception opening formed in the inner end of the drive shaft to receive the pin projecting from the bushing and a spring located within the reception opening to push the pin. The pin in the reception opening limits the swing angle of the bushing, and the spring biases the bushing and orbital scroll to thereby reduce the circle in which the orbiting scroll orbits.

Further objects, features and other aspects of this invention will be understood from the following detailed description of the preferred embodiments of this invention referring to annexed drawings.

BRIEF DESCRIPTION OF THE DRAWINGS

FIG. 10*b* is an explanatory view of the dynamic balance in the apparatus of FIG. 10*a.

DETAILED DESCRIPTION OF THE PREFERRED EMBODIMENTS

Figure 1:
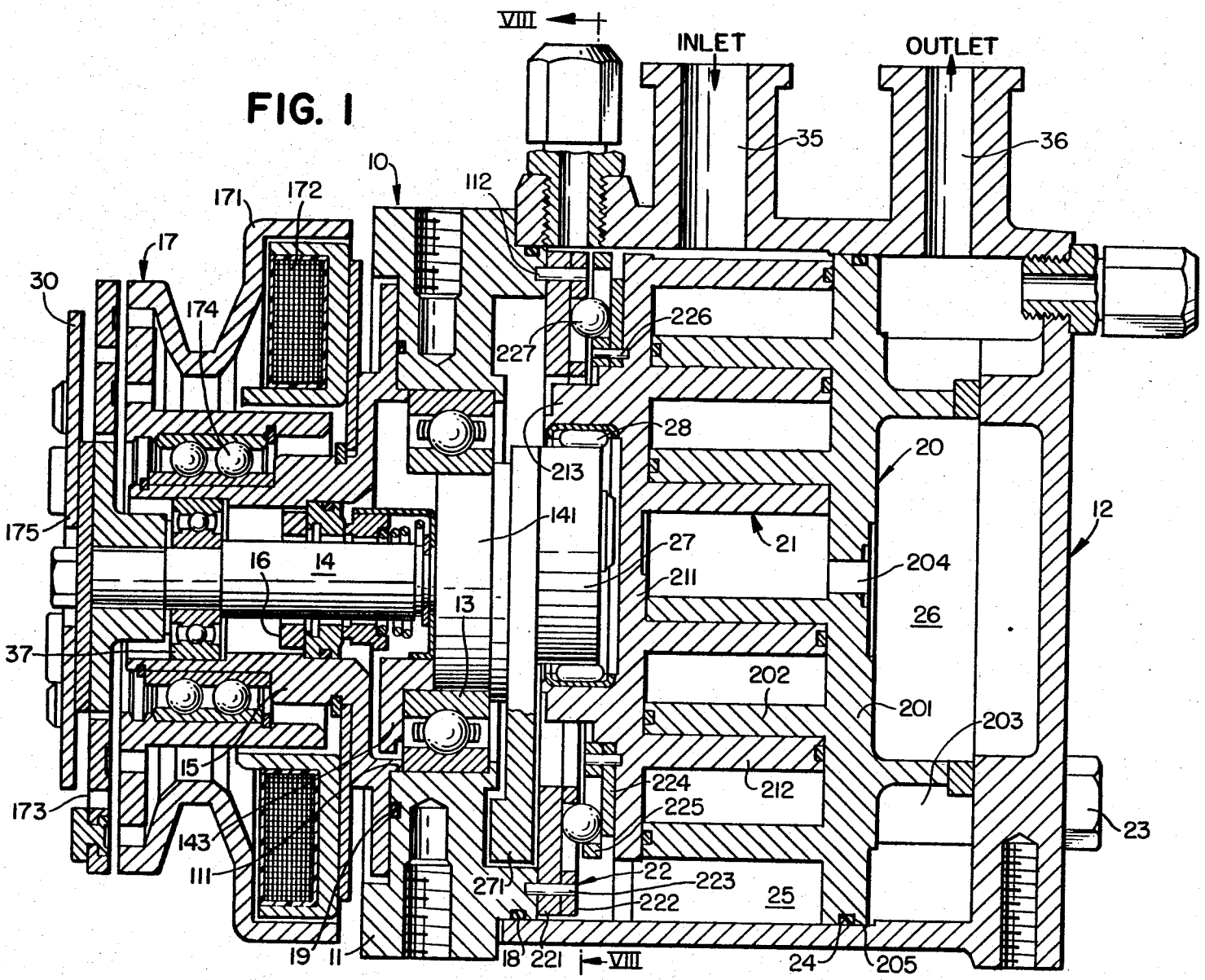
FIG. 1 is a vertical sectional view of a compressor-type fluid displacement apparatus according to one embodiment of this invention.

Referring to FIG. 1, a fluid displacement apparatus in accordance with one embodiment of the present invention, in particular a scroll-type refrigerant compressor is shown. The compressor includes a housing 10 comprising a front end plate 11 and a cup-shaped casing 12 fastened to an end surface of front end plate 11. An opening 111 is formed in the center of front end plate 11 for supporting a drive shaft 14. The center of drive shaft 13 is thus aligned or concentric with the center line of housing 10. An annular projection 112, concentric with opening 11, is formed on the rear end surface of front end plate 11 and faces cup-shaped casing 12. The annular projection 112 contacts an inner wall of the opening of cup-shaped casing 12. Cup-shaped casing 12 is attached to the rear end surface in front end plate 11 by a fastening device, such as bolts and nuts (not shown), so that the opening of cup-shaped casing 12 is covered by front end plate 11. An O-ring 18 is placed between the outer peripheral surface of annular projection 112 and the inner wall of the opening of cup-shaped casing 12 to seal the mating surfaces between front end plate 11 and cup-shaped casing 12.

Drive shaft 14 is formed with a disk-shaped rotor 141 at its inner end portion. Disk-shaped rotor 141 is rotatably supported by front end plate 11 through a bearing 13 located within opening 111. Front end plate 11 has an annular sleeve 15 projecting from its front end surface. Sleeve 15 surrounds drive shaft 14 to define a shaft seal cavity. A shaft seal assembly 16 is assembled on drive shaft 14 within the shaft seal cavity. An O-ring 19 is placed between the front end surface of front end plate 11 and sleeve 15 to seal the mating surfaces between front end plate 11 and sleeve 15. As shown in FIG. 1, sleeve 15 is formed separately from front end plate 11 and is attached to the front end surface of front end plate 11 by screws (not shown). Alternatively, sleeve 15 may be formed integral with front end plate 11.

An electromagnetic clutch 17 is supported on the outer surface sleeve 15 and is connected to the outer end portion of drive shaft 14. Electromagnetic clutch 17 comprises a pulley 171 rotatably supported by sleeve 15 through a bearing 174 carried on the outer surface of sleeve 15, a magnetic coil 172 which extends into an annular cavity of pulley 171 and is fixed on sleeve 15 by a support plate, and an armature plate 173 fixed on the outer end portion of drive shaft 14 which extends from sleeve 15. Drive shaft 14 is thus driven by an external power source; for example, the engine of a vehicle through a rotation transmitting device, such as above-described electromagnetic clutch 17.

A number of elements are located within the inner chamber of cup-shaped casing 12 including a fixed scroll 20, an orbiting scroll 21, a driving mechanism for orbiting scroll 21, and a rotation preventing/thrust bearing device 22 for orbiting scroll 21. The inner chamber of cup-shaped casing 12 is formed between the inner wall of cup-shaped casing 12 and the rear end surface of front end plate 11.

Fixed scroll 20 includes a circular end plate 201, a wrap or spiral element (spiroidal wall) 202 affixed to or extending from one end surface of circular end plate 201, and a plurality of internal bosses 203. The end surface of each boss 203 is seated on an inner end surface of end plate portion 121 of cup-shaped casing 12 and is fixed on end plate portion 121 by a plurality of bolts 23, one of which is shown in FIG. 1. Circular end plate 201 of fixed scroll 20 partitions the inner chamber of cup-shaped casing 12 into a discharge chamber 26 having bosses 203, and a suction chamber 25, in which spiral element 202 of fixed scroll 20 is located. A sealing member 24 is placed within a circumferential groove 205 in circular end plate 201 to form a seal between the inner wall of cup-shaped casing 12 and outer peripheral surface of circular end plate 201. A hole or discharge port 204 is formed through circular end plate 201 at a position near the center of the spiral elements to communicate between discharge chamber 26 and the spiral elements center.

Orbiting scroll 21, which is dosposed in suction chamber 25, includes a circular end plate 211 and a wrap or spiral element (spirodal wall) 212 affixed to or extending from one end surface of circular end plate 211. Both spiral elements 202, 212 interfits at an angular offset of 180° and a predetermined radial offset to make a plurality of line contacts. The spiral elements define at least one pair of fluid pockets between their interfitting surfaces. Orbiting scroll 21 is connected to the driving mechanism and rotation preventing/thrust bearing device to effect orbital motion of orbiting scroll 21 at a circular radius Ror by the rotation of drive shaft 13 and thereby compress fluid passing through the compressor.

Generally, radius Ror of orbital motion is given by:

$$\frac{\text{(the pitch of the spiral element)} - \text{2(the wall thickness of the spiral element)}}{2}$$

Figure 11:
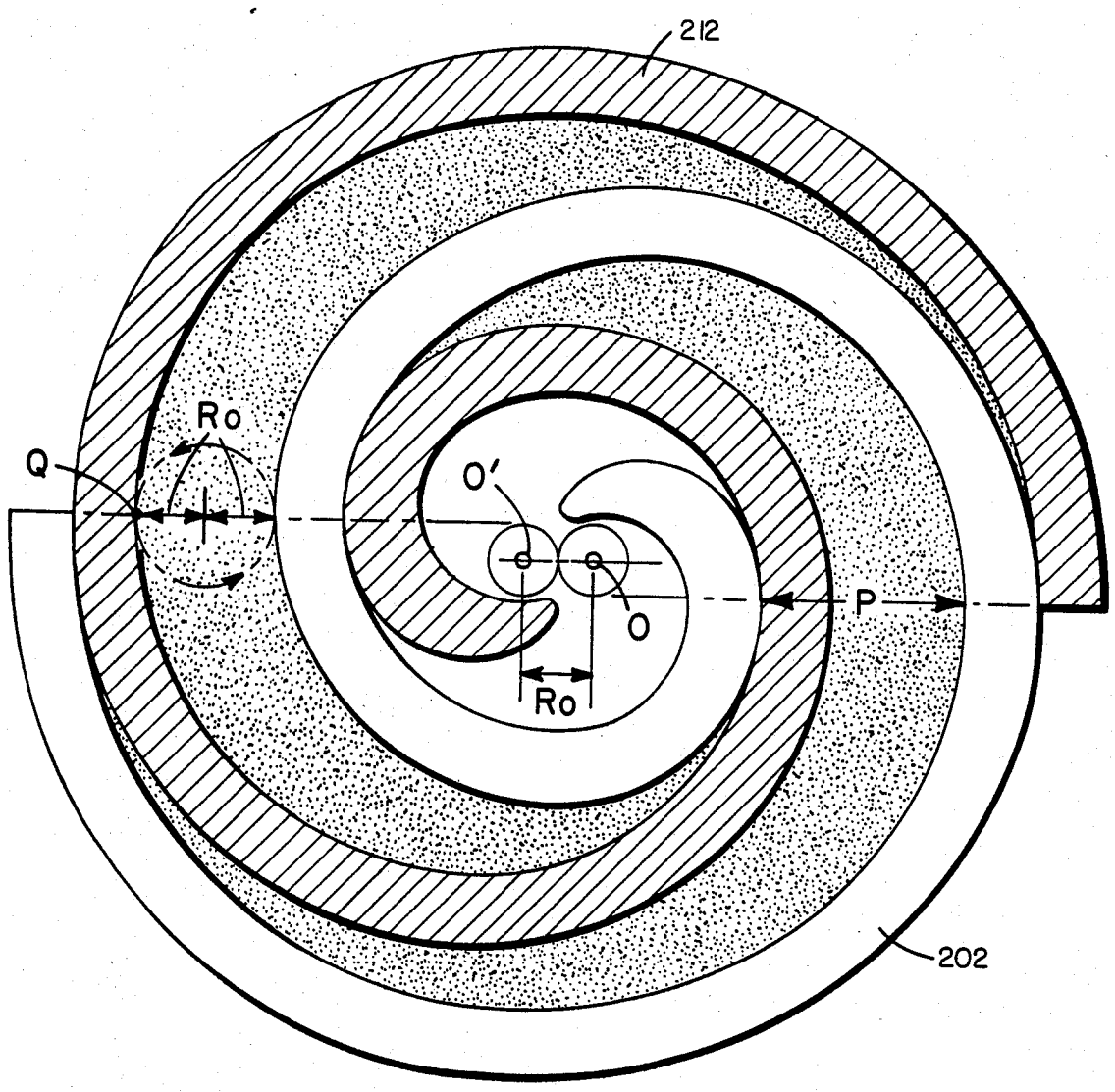
* and FIG. 11 is a diagrammatic sectional view illustrating the spiral elements of fixed and orbiting scrolls.

As seen in FIG. 11, the pitch (P) of the spiral element can be defined by $2\pi rg$, where rg is the involute generating circle radius. The radius Ror of orbital motion is also illustrated in FIG. 11, as a locus of an arbitrary point Q on orbiting scroll 21. The center of spiral element 212 is placed radially offset from the center of spiral element 202 by the distance Ror. Thereby, orbiting scroll 21 is allowed to undergo orbital motion of radius Ror by the rotation of drive shaft 14. As the orbiting scroll 21 orbits, line contacts between both spiral elements 202 and 212 shift to the center of the spiral elements along the surfaces of the spiral elements. The fluid pockets defined between spiral elements 202 and 212 move to the center of the spiral elements with the consequent reduction of volume, to thereby compress the fluid in the fluid pockets. Fluid or refrigerant gas, introduced into suction chamber 25 through a fluid inlet port 35 on cup-shaped casing 12, is taken into fluid pockets, is compressed and the compressed fluid is discharged into discharge chamber 26 from the fluid pocket at the spiral element's center through hole 204. The compressed fluid is thereafter discharged through a fluid outlet port 36 on cup-shaped casing 12 to an external fluid circuit; for example, a cooling circuit.

Figure 2A:
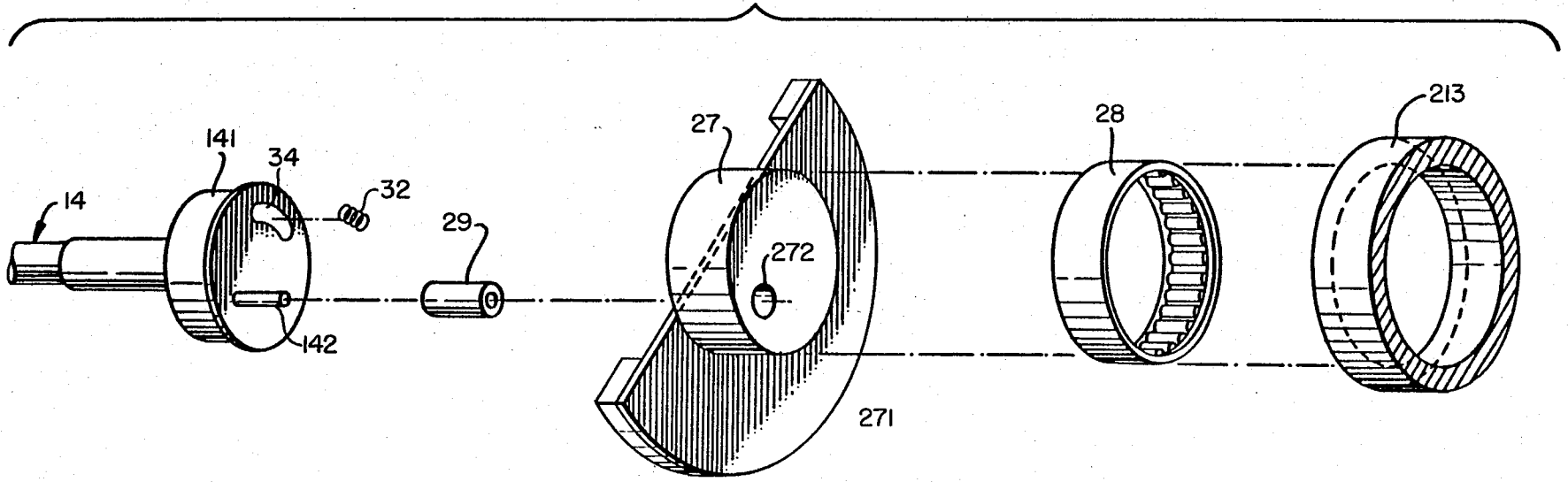
FIG. 2*a* is an exploded perspective view of the driving mechanism in FIG. 1.
Figure 2B:
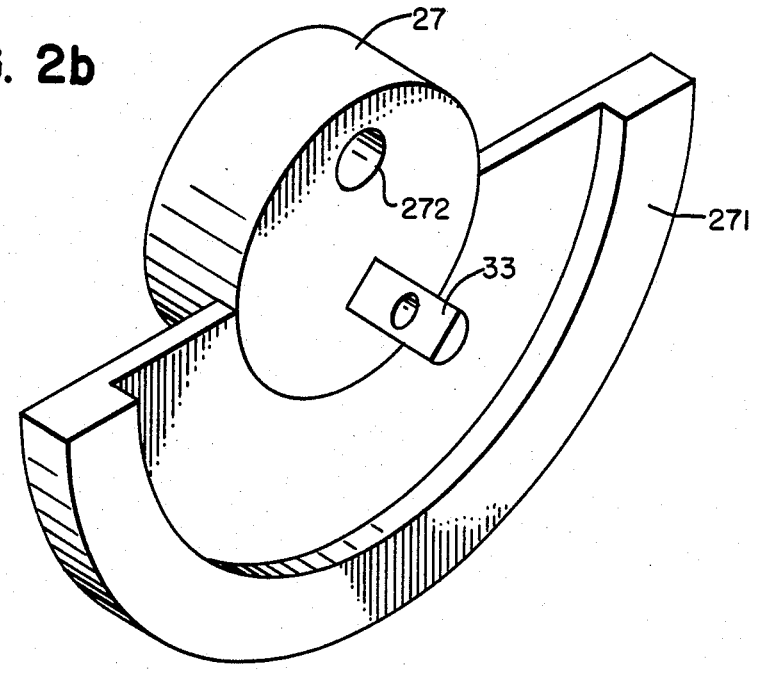
FIG. 2*b* is a perspective view of the bushing, viewed from the opposite side of FIG. 2*a;*
Figure 3:
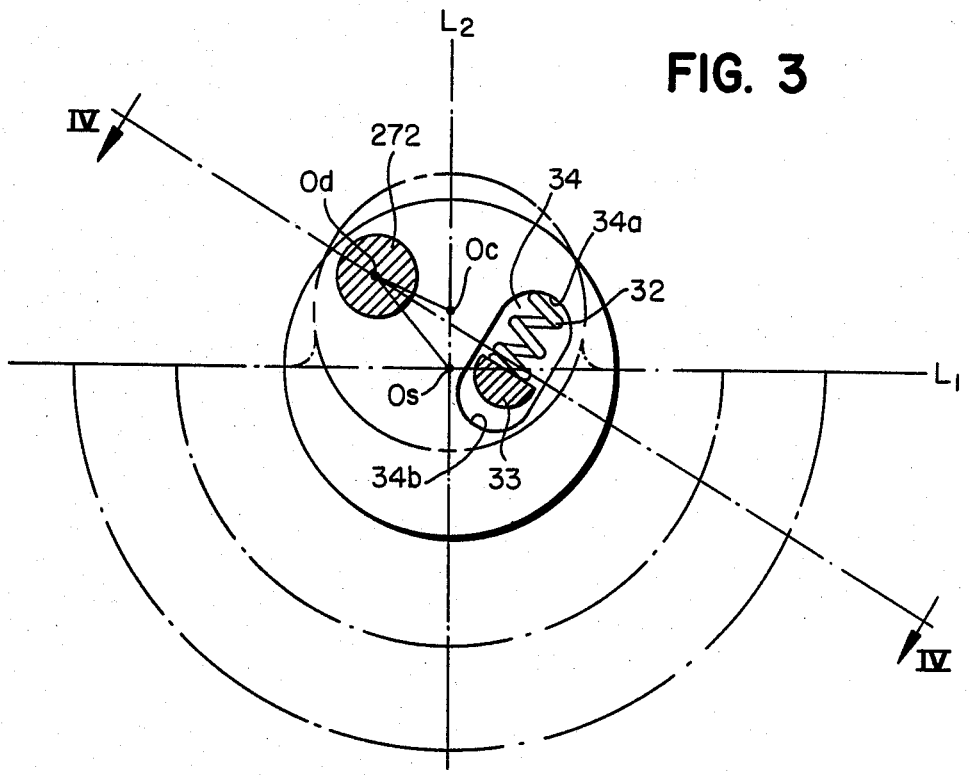
FIG. 3 is a vertical sectional view of the driving mechanism illustrating the relationship between the drive pin and the bushing.
Figure 4:
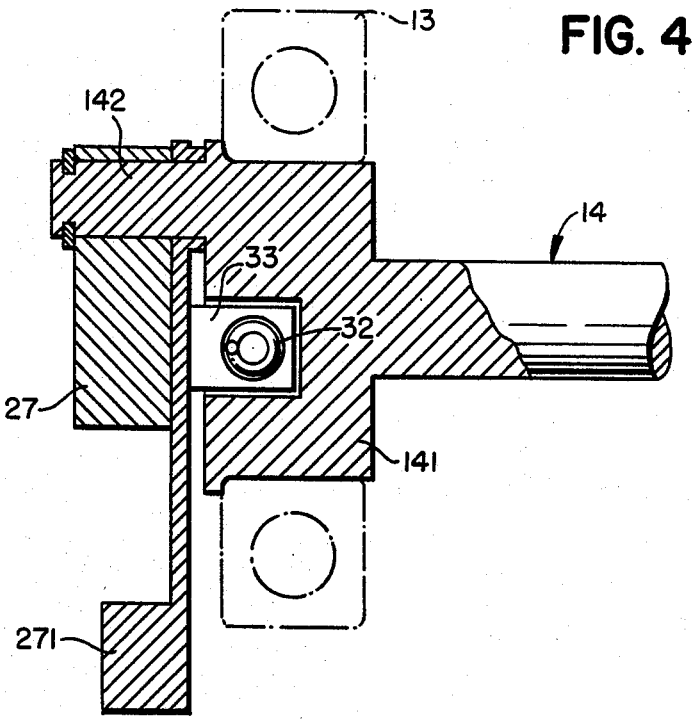
FIG. 4 is a sectional view taken generally along line IV—IV in FIG. 3.

Referring to FIGS. 2, 3 and 4, the driving mechanism of orbiting scroll 21 will be described in greater detail. Drive shaft 14 is formed with disk-shaped rotor 141 at its inner end portion and is rotatably supported by front end plate 11 through bearing 13 located within opening 111 of front end plate 11. A crank pin or drive pin 142 projects axially from an axial end surface of disk-shaped rotor 141 and is radially offset from the center of drive shaft 14. Circular end plate 211 of orbiting scroll 21 has a tubular boss 213 axially projecting from the end surface opposite from which spiral element 212 extends. A discoid or short axial bushing 27 fits into boss 213, and is rotatably supported therein by a bearing, such a needle bearing 28. Bushing 27 has a balance-weight 271 which is shaped as a portion of a disc or ring and extends radially from the bushing 27 along a front end surface thereof. An eccentric hole 272 is formed in the bushing 27 at a position radially offset from the center of bushing 27. Crank pin 142 fits into the eccentrically disposed hole 272 together with a bearing 29. Bushing 27 is therefore driven in an orbital path by the revolution of drive pin 142 and can rotate within needle bearing 28.

A mechanism for restricting the angle through which bushing 27 can pivot or swing (the swing angle) around crank pin 142 is connected between disk-shaped rotor 141 and bushing 27. The restriction mechanism comprises an axial projection, such as pin 33, projecting from the axial end surface of bushing 27, a reception opening 34 formed on the axial end surface of disk-shaped rotor 141 and having opposing closed ends **34*a* and 34*b*, and a spring 32. Pin 33 is smaller than opening 34 so that a gap is left around pin 33. Spring 32 is placed in the gap between pin 33 and the inner wall of opening 34. Spring 32 pushes bushing 27 through pin 33 in the direction to separate the line contacts between the spiral elements 202 and 212; i.e., to reduce the orbital radius of orbiting scroll 21. The separation is maintained by spring 32 until the rotation of drive shaft 14 reaches an established rotational frequency; i.e., the frequency at which the compressor is designed to operate. Spring 32 thus functions to keep spiral elements 202 and 212 out of radial contact when the compressor starts up in order to reduce the power required to start the compressor. The compressor thus starts in an unloaded (non-compression) state and remains in this state until the rotational speed of the orbiting parts is sufficient to generate a centrifugal force of a magnitude to overcome the urging force of spring 32** and radial sealing occurs between the spiral elements. As will be discussed hereinafter, the masses of the orbiting parts and balanceweight are selected so that radial sealing occurs at the intended operating speed of the compressor.

Figure 5:
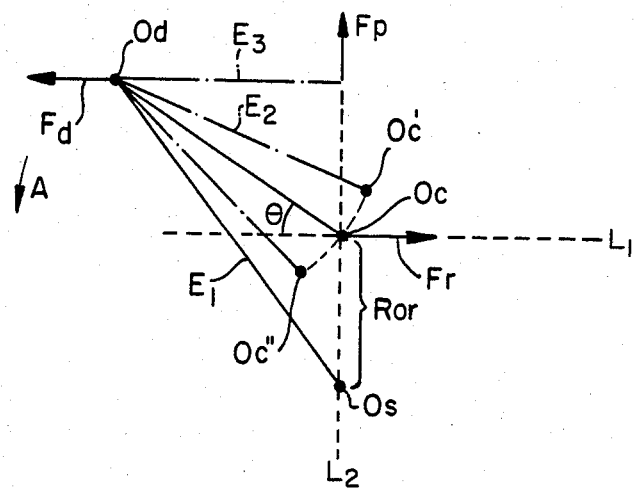
FIG. 5 is an explanatory diagram of the motion of the eccentric bushing in FIG. 1.

In this construction of a driving mechanism, center Oc of bushing 27 can swing about the center Od of drive pin 142 at a radius $E_2$, as shown in FIG. 5. Such swing motion of center Oc is illustrated as arc Oc'-Oc" in FIG. 5. This swing motion allows orbiting scroll 21 to compensate its motion for changes in Ror due to wear on the spiral elements 202, 212 or due to other dimensional inaccuracies of the spiral elements. When drive shaft 14 rotates about its center Os, a drive force Fd is exerted at Od to the left and a reaction force Fr of gas compression appears at Oc to the right, with both forces being parallel to line $L_1$ which extends through Oc and is perpendicular to line $L_2$ and through Oc and Os. Therefore, the arm Od-Oc can swing outward by the creation of the moment generated by forces Fd and Fr so that, spiral element 212 of orbiting scroll 21 orbits with the radius Ror around center Os of drive shaft 14. The rotation of orbiting scroll 21 is prevented by rotation preventing/thrust bearing device 22, described more fully hereinafter, whereby orbiting scroll 21 orbits and keeps its relative angular relationship.

The use of bushing 27 with eccentric hole 272 has the following advantages.

When fluid in the fluid pockets is compressed by orbital motion of orbiting scroll 21, reaction force Fr, caused by the compression of the fluid, acts on spiral element 212. This reaction force Fr acts in a direction tangential to the circle of the orbital motion. This reaction force, which is shown as Fr of FIG. 5, in the final analysis, acts on center Oc of bushing 27. Since bushing 27 is rotatably supported by crank pin 142, bushing 27 is subject to a rotating moment generated by Fd and Fr with radius $E_2$ around center Od of drive pin 142. This moment is defined as Fd ($E_2$) (sin $\phi$), where $\phi$ is the angle between the line Od-Oc and line $L_1$, because Fd=Fr. Orbiting scroll 21, which is supported by bushing 27, is also subject to the rotating moment with radius $E_2$ around center Od of drive pin 142 and, hence, the rotating moment is also transferred to spiral element 212. This moment urges spiral element 212 against spiral element 202 with an urging force Fp. Fp acts through a moment arm $E_3=E_2$ (cos $\phi$). Since the moments are equal, Fp ($E_2$) (cos $\phi$)=Fd ($E_2$) (sin $\phi$). Thus, urging force Fp=Fd(tan $\phi$). When orbiting scroll 21 is driven through bushing 27 having eccentric hole 271, the urging force which acts at the line contact between both spiral element 202, and 212 will be automatically derived from the reaction force whereby a seal of the fluid pockets is attained.

In addition, center Oc of bushing 27 is rotatable around center Od of drive pin 142. Therefore, if a pitch of spiral element or a wall thickness of a spiral element, due to manufacturing inaccuracy or wear, has a dimensional error, distance Oc-Od can change to accommodate or compensate for the error. Orbiting scroll 21 thereby moves smoothly along the line of contacts between the spiral elements. If only the urging force Fp acts on the spiral element 212 of orbiting scroll 21 to press it against spiral element 202 of fixed scroll 20, the center Oc swings as seen in FIG. 5, and a balanceweight is not needed when the centrifugal force is not excessive. But, in a dynamic situation, Fp is not the only force urging the spiral elements together. If bushing 27 is not provided with balanceweight 271, a centrifugal force $F_1$ caused by orbital motion of orbiting scroll 21, bearing 28 and bushing 27 is added to the urging force Fp. Since the centrifugal force $F_1$ is proportional to the orbiting speed of the orbital parts, the contact force between the spiral element 202 and 212 would also increase as the drive shaft speed increases. Friction force between spiral elements 202 and 212 would thereby be increased, and wearing of both spiral elements and also mechanical friction loss would increase.

Therefore, to cancel the centrifugal force $F_1$, a balanceweight 271 is connected to bushing 27 to generate a centrifugal force $F_2$. The mass of the balanceweight 271 is selected so that the centrifugal force $F_2$ is equal in magnitude to the centrifugal force $F_1$ and located so that the centrifugal forces $F_1$ and $F_2$ are opposite in direction. Wear of both spiral elements will thereby also be decreased; while the sealing force of Fp of the fluid pockets, which is independent of shaft speed, will secure the contact between the spiral elements as described in FIG. 5.

The selection of masses which results in $F_1$ being equal to $F_2$ is desirable in a compressor where no spring 32 is used in the swing angle restriction device. However, in the present invention, where spring 32 biases the spiral elements out of contact with one another, it is not desirable to have $F_1$ precisely equal to $F_2$. The selection of an appropriate mass for balanceweight 271, when spring 32 is used, will be discussed more fully hereinafter.

As mentioned above, suitable sealing force of the fluid pocket is accomplished by using bushing 27 having balanceweight 271. However, a centrifugal force $F_1$ arises due to orbital motion of orbiting scroll 21, bearing 28 and the portion of bushing 27 excluding balanceweight 271; and centrifugal force $F_2$ arises due to the orbital motion of balanceweight 271. Centrifugal forces $F_1$ and $F_2$ are made equal in magnitude; however, the direction of the forces is opposed. Since the acting points of these centrifugal forces are spaced apart axially, a moment arises and vibration of the compressor can occur.

Acting point of $F_1$ is a centroid; i.e., center of mass, $G_1$ of orbiting scroll 21, bearing 28 and bushing 27, and acting point of $F_2$ is a centroid $G_2$ of balanceweight 271. Balanceweight 271, which is attached to bushing 27 and thereby coupled to orbiting scroll 21, is axially offset from orbiting scroll 21; i.e., the centroid $G_2$ is axially offset from centroid $G_1$ by a distance $e_1$. Therefore, $G_1$ is not aligned with centroid $G_2$ in axial direction of the drive shaft 14. To prevent vibration caused by the moment created by this axial offset, the compressor unit is provided with a canceling mechanism which is shown in FIG. 1. Drive shaft 14 is provided with a pair of balanceweights 143, 30. Balanceweight 143 is placed on drive shaft 14 near or adjacent to balanceweight 271 to cause a centrifugal force $F_3$ in the same direction as the centrifugal force $F_2$ of balanceweight 271. Balanceweight 30 is placed on shaft 14 on an opposite radial side of drive shaft 14 as balanceweight 143 and on an opposite side in the axial direction relative to balanceweight 271. Balanceweight 30 causes a centrifugal force $F_4$ in a direction opposite to that of centrifugal force $F_3$ of balanceweight 143. Balanceweight 30 is fixed to or formed integral with a stopper plate 175 which is supported by armature 173 of the magnetic clutch 17.

Figure 6:
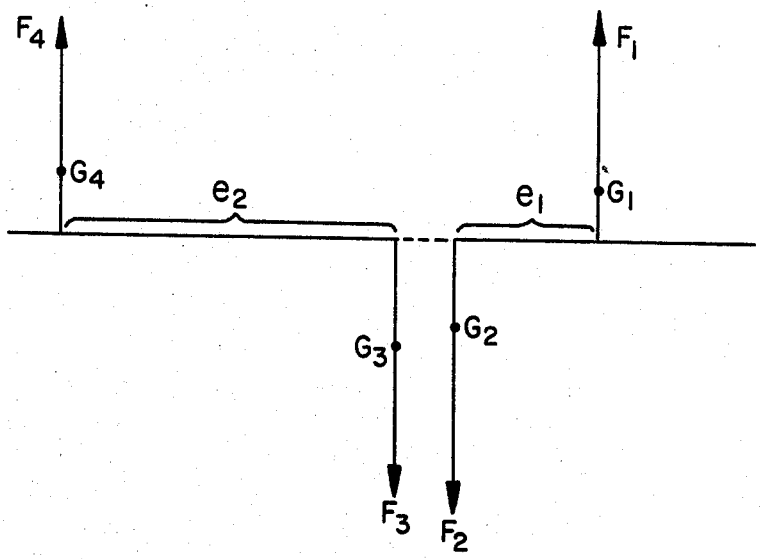
FIG. 6 is an explanatory diagram of the dynamic balance in the apparatus in FIG. 1.

The relation of the centrifugal forces $F_1$, $F_2$, $F_3$ and $F_4$ is shown in FIG. 6. As mentioned above, centrifugal force $F_1=F_2$ so that this moment; i.e., the moment created by the axial offset of centroids $G_1$ and $G_2$, is defined by $F_1(e_1)$, where $e_1$ is distance from centroid $G_2$ of balance weight 271 along the axis of drive shaft 14. Another moment is created due to the centrifugal forces created by the rotation of axially-spaced balanceweights 143, 30. The mass of balanceweights 143 and 30 is designed so that $F_3=F_4$. This moment is shown as $F_3(e_2)$ and the direction of rotation caused by this moment is opposed to the moment $F_1(e_1)$ where $e_2$ is a distance between centroid $G_3$ of balanceweight 143 and centroid $G_4$ of balanceweight 30 along the axis of drive shaft 14. To prevent vibration of the compressor, the distance $e_2$ and/or the unbalance amount (i.e., mass) of 143, 30 is selected so that $F_1(e_1)=F_3(e_2)$.

Figure 7:
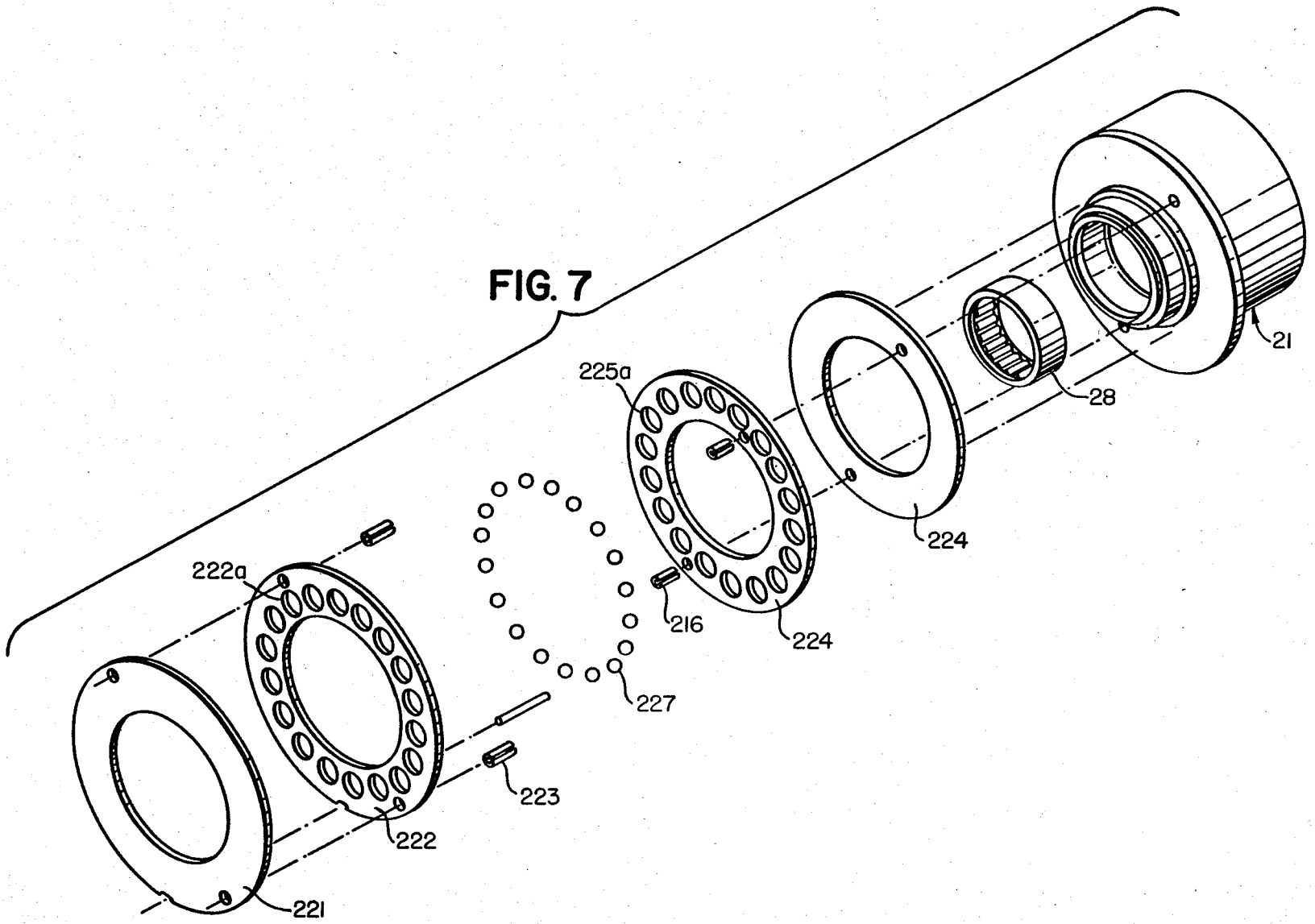
FIG. 7 is an exploded perspective view of the rotation preventing/thrust bearing device in FIG. 1.

Referring to FIG. 7, the rotation preventing/thrust bearing device 22 will be described. Rotation preventing/thrust bearing device 22 is disposed between the rear end surface of front end plate 11 and the end surface of circular end plate 211 of orbiting scroll 21 on the side opposite spiral element 212. Rotation preventing/thrust bearing device 22 includes a fixed portion, an orbital portion and a bearing element, such as a plurality of spherical balls.

The fixed portion includes an annular fixed race 221 having one end surface fitted against the axial end surface of annular projection 112 of front end plate 11, and a fixed ring 222 fitted against the other axial end surface of fixed race 221. Fixed race 221 and fixed ring 222 are attached to the axial end surface of annular projection 112 by pins 223.

The orbital portion also includes an annular orbital race 224, which has one end surface fitted against an axial end surface of circular end plate 211, and an orbital ring 225 fitted against the other axial end surface of orbital race 224 to extend outwardly therefrom and cover the other axial end surface of orbital race 224. A small clearance is maintained between the end surface of fixed ring 222 and the end surface of orbital ring 225. Orbital race 224 and orbital ring 225 are attached to the end surface of circular end plate 211 by pins 226. Alternatively, rings 222, 225 may be formed integral with races 221, 224, respectively.

Fixed ring 222 and orbital ring 225 each have a plurality of holes or pockets **222*a* and 225*a* in the axial direction, the number of holes or pockets in each of rings 222 and 225 being equal. The holes or pockets 222*a* on fixed ring 222 correspond to or are a mirror image of the holes or pockets 225*a* on orbital ring 225; i.e., each pair of pockets facing each other have the same size and pitch, and the radial distance of the pockets from the center of their respective rings 222 and 225 is the same; i.e., the centers of the pockets are located the same distance from the center of rings 222 and 225. Thus, if the centers of rings 222 and 225 were aligned, which they are not in actual operation of the rotation preventing/thrust bearing device 22, the holes or pockets 222***a* and 225*a* would be identical or in alignment. Bearing elements, such as balls 227, are placed between facing generally aligned pairs of pockets 222*a* and 225*a* of fixed and orbital rings 222, 225 with the rings 222, 225 facing one another at a predetermined clearance.

Figure 8:
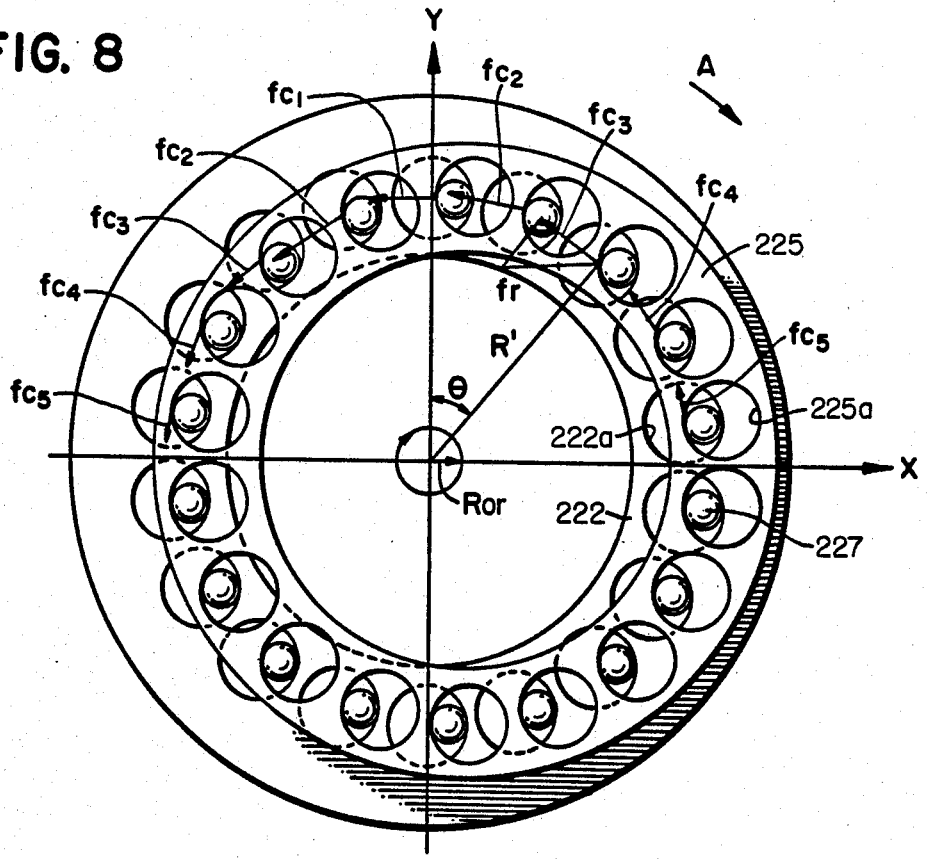
FIG. 8 is a sectional view taken along generally line VIII—VIII of FIG. 1, illustrating the operation of the rotation preventing/thrust bearing device.

Referring to FIG. 8, the operation of the rotation preventing/thrust bearing device 22 will be described. In FIG. 8, the center of orbital ring 225 is placed at the right side and the direction of rotation of the drive shaft is clockwise as indicated by arrow A. When orbiting scroll 21 is driven by the rotation of the dirve shaft, the center of orbital ring 22 orbits about a circle of radius $R_O$ (together with orbiting scroll 21). However, a rotating force; i.e., moment, which is caused by the offset of the acting point of the reaction force of compression and the acting point of drive force, acts on orbiting scroll 22. This reaction force tends to rotate orbiting scroll 22 in a clockwise direction about the center of orbital ring 225. But, as shown in FIG. 8, eighteen balls 227 are placed between the corresponding pockets 222*a* and 225*a* of rings 222 and 225. In the position shown in FIG. 8, the interaction between the nine balls 227 at the top of the rotation preventing/thrust bearing device and the edges of the pockets 222*a* and 225*a* prevents the rotation of orbiting scroll 21. The magnitude of the rotation preventing forces are shown as $fc_1$-$fc_5$ in FIG. 8. In the situation or orientation illustrated in FIG. 8, the balls 227, which are placed underneath; i.e., below line X, do not interact with pockets 222*a* and 225*a* to prevent rotation. In any given position or orbiting scroll 21 and orbital ring 225 about the orbit radius $R_O$, only half the balls 227 and pockets 222*a* and 225*a* function at various degrees to prevent rotation of the orbiting scroll 21; however, all the balls 227 support the axial thrust load from orbiting scroll 21. This axial thrust load is transmitted to fixed ring 221 through all of balls 227.

As mentioned above, if the unbalance amount Ucw of balanceweight 271 (centrifugal force $F_2$) is selected to equal the unbalance amount Uos of the orbital parts (centrifugal force $F_1$), such as orbiting scroll 21, bearing 28 and bushing 27, the contact force between spiral elements 202, 212 results only from the urging force Fp caused by the driving mechanism and is not influenced by the centrifugal force $F_1$ caused by the orbital motion of the orbital parts. Wear of the spiral elements, particularly at high rotational speeds, is thus prevented.

However, in this invention, spring 32 is placed within opening 34 of disk-shaped rotor 141 and pushes pin 33 in the direction to separate the line contacts between both spiral elements 202, 212; i.e., to reduce the orbital radius of orbiting scroll 21. Spring 32 thus creates a force Fs which acts in a direction opposite to the centrifugal force $F_1$ of the orbiting parts. If the unbalance amounts Uos and Ucw (masses of the parts causing centrifugal forces $F_1$ and $F_2$, respectively) were equal, the centrifugal forces caused by them would cancel one another and the additional force Fs would prevent the contact of the spiral elements and the formation of the sealed-off fluid pockets. Thus, the relationship between the two unbalance amounts is selected so that Uos is greater than Ucw in order to create a differential unbalance $\Delta U = Uos - Ucw$. The differential unbalance $\Delta U$ is correlated with the spring force Fs so that the radial contact of the spiral element and compression does not occur until the established rotational frequency is reached. The urging force Fs of spring 32 is therefore selected equal to the resultant centrifugal force of both unbalance amounts at the established rotational frequency. Thus, urging force Fs of spring 32 is given by $Fs = \Delta U\ w^2/g$, where w is the angular velocity of drive shaft 13 at the established rotational frequency.

In this construction, bushing 27 can not rotate around crank pin 142 until the established rotational frequency is reached and the radial gap between the spiral elements 202, 212 is caused. With the radial gap, the compressor can not operate in a compression cycle. Once the rotational frequency reaches the established rotational frequency, the centrifugal force of the orbital parts overcomes the urging force of spring 32, bushing 27 can rotate around crank pin 142 and the line contacts between both spiral elements 202, 212 is secured. The compression cycle thus starts, but with less energy expended during start-up.

Figure 9A:
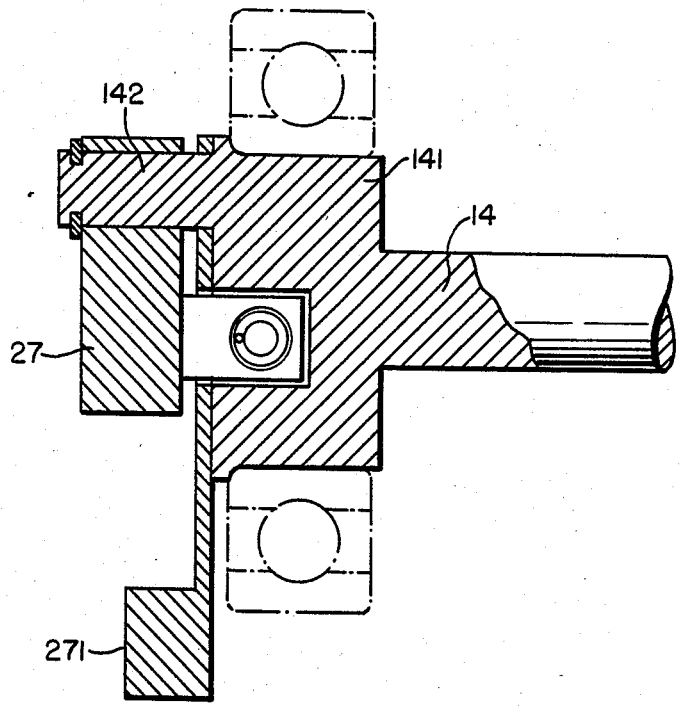
FIG. 9*a* is a sectional view similar to FIG. 4 illustrating another embodiment of drive mechanism according to this invention.
Figure 9B:
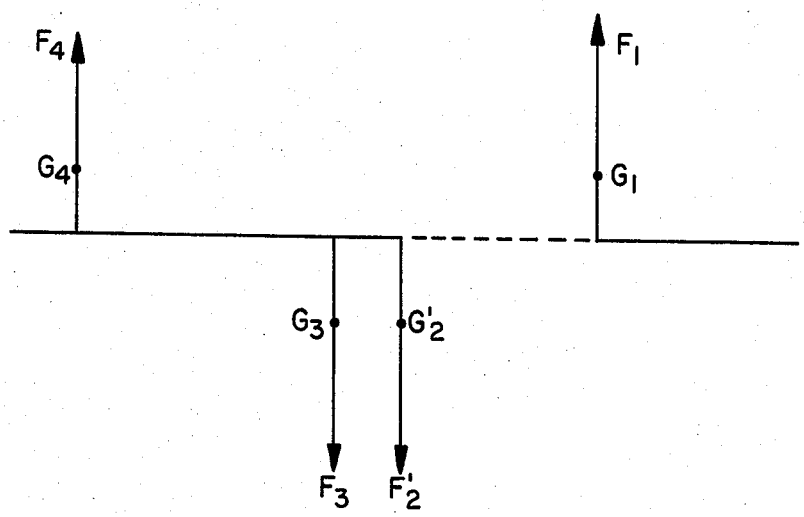
FIG. 9*b* is an explanatory view of the dynamic balance in the apparatus of FIG. 9*a;*

Referring to FIGS. 9*a* and 9*b*, another embodiment of a driving mechanism for a fluid displacement apparatus is shown. This embodiment is directed to a modification of the arrangement of the balanceweight which extends from bushing 27 in the above-described embodiment. Usually, the balanceweight 271 extends from bushing 27 to cancel the centrifugal force caused by the orbital motion of the orbital parts and thereby prevent the wearing of the spiral elements. However, if the compressor is used at lower speeds, it is not necessary to completely cancel the centrifugal force of the orbiting parts. Furthermore, since bushing 27 is pushed by spring 32, the centroid of mass of balanceweight 271 is offset from the center line of drive shaft 14 during the stopped stage of the compressor. Since the line contacts cannot form until the centrifugal force of the orbital parts overcomes the total force of the centrifugal force of balanceweight 271 and the urging force of spring 32, high rotational frequency is generally needed to make the line contacts when starting such a compressor. Therefore, the construction, which is shown in FIGS. 1 and 4, is not suitable for use in a lower speed compressor.

Thus, in the embodiment shown in FIGS. 9*a* and 9*b*, balanceweight 271 is fixed on the end surface of disk-shaped rotor 141 to avoid above disadvantages and to allow the compressor to operate at lower speeds. In this construction, the centrifugal force of balanceweight 271 does not influence the formation of line contacts between the spiral elements because the centrifugal force of balanceweight 271 acts directly on the drive shaft 14 and not directly on bushing 27. Thereby, the established rotation frequency needed to form the line contacts and start the compression cycle is reduced and the compressor can operate lower speeds. The relation of the dynamic balance is shown in FIG. 9*b*. In this figure, the centrifugal force $F_2$ is moved to the drive shaft 14 side; however, the total balance situation is not changed. The unbalance amount of balanceweight 271 is thus made less than the unbalance amount of the orbiting member and bushing.

Figure 10A:
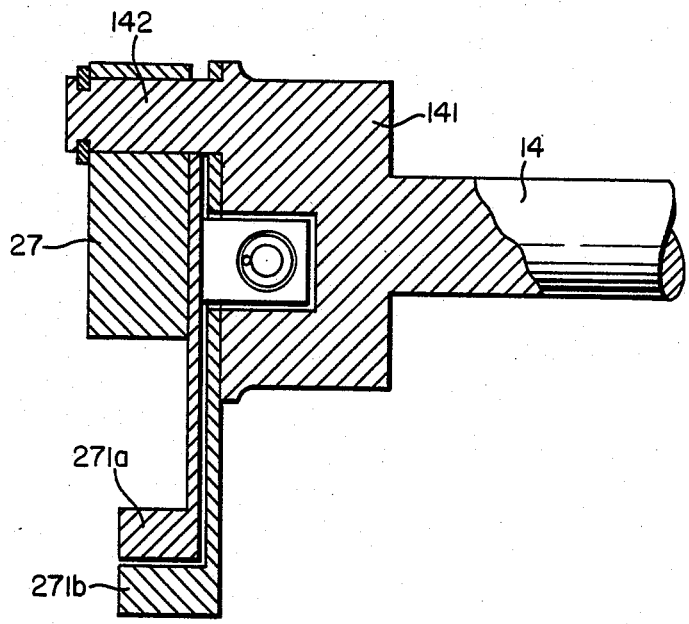
FIG. 10*a* is a sectional view similar to FIG. 4 illustrating another embodiment of drive mechanism according to this invention.
Figure 10B:
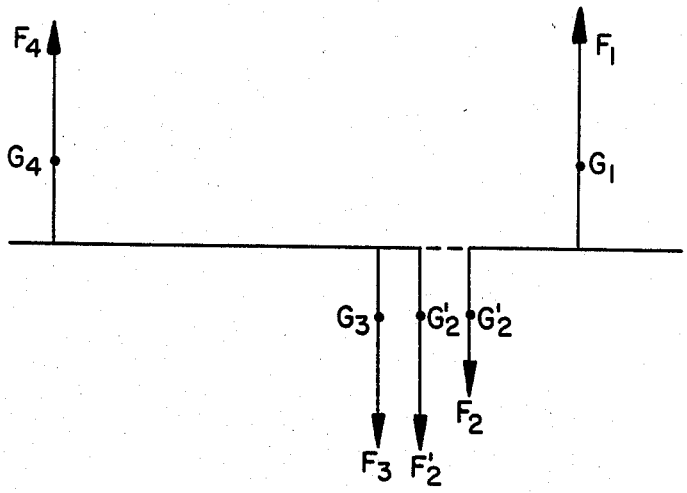

Referring to FIGS. 10*a* and 10*b*, another embodiment of a drive mechanism for a fluid displacement apparatus is shown. This embodiment is also directed to a modification in the arrangement of balanceweight 271. In this embodiment, the balanceweight 271 is partitioned into two parts 271*a*, 271*b*. Balanceweight 271*a* is fixed on bushing 27 and the other balanceweight 271*b* is fixed on disk-shaped rotor 141. Balanceweight 271*a* influences the formation of the line contacts and the initiation of compression, as does the balanceweight in the first embodiment; while balanceweight 271*b* does not have such an influence, as does the balanceweight of the second embodiment. Once a desired established rotational frequency is selected, the size of the required balanceweight 271*a* can be determined. Thereafter, any additional counterbalance force $F_2$, which is required to attain dynamic balance, can be attained through the appropriate selection of the size of balanceweight 271*b*. The total unbalance amount of balanceweights 271*a* and 271*b* is thus made less than the unbalance amount of the orbiting member and bushing.

This invention has been described in detail in connection with the preferred embodiments, but these are examples only and the invention is not restricted thereto. It will be easily understood by those skilled in the art that other variations and modifications can be easily made within the scope of this invention.

What is claimed:

1. In a fluid displacement apparatus including a housing having a front end plate, a fixed fluid displacement member fixedly disposed relative to said housing, an orbiting fluid displacement member having an end plate from which an orbiting wall extends, said orbiting member interfitting with said fixed member to make a plurality of line contacts to define at least one sealed-off fluid pocket, a drive shaft rotatably supported by said front end plate, a drive pin extending from an inner end of said drive at a location eccentric with respect to the axis of said drive shaft, said end plate of said orbiting member having a boss disposed on one of its side surfaces, a bushing rotatably supported by said boss, said bushing having an eccentric hole located eccentrically with respect to the center of said bushing and said drive pin being inserted in said eccentric hole and rotatably connected to said bushing whereby said orbiting member is moved in orbital motion by the rotation of said drive shaft, the improvement comprising:

restriction means coupled between said drive shaft and said bushing for restricting the swing angle of said bushing around said drive pin, said restriction means including a projection and an elongate reception opening, said projection extending from one of said bushing and said inner end of said drive shaft, and said elongate reception opening having opposing closed ends and being formed in the other of said bushing and said inner end of said drive shaft, said projection extending into said elongate reception opening, and said restriction means including spring means for urging said orbiting member in a direction to reduce the orbital radius of said orbiting member and to bias said wall of said orbiting member out of contact with said fixed member when said orbiting member is not driven, said spring means including a spring disposed within said elongate reception opening and said projection being movable along substantially the entire length of said elongate reception opening, except for the area occupied by said spring; and said bushing having a balance weight for canceling unbalance caused by the orbiting motion of said orbiting member and said bushing, and the unbalance amount of said balance weight being smaller than the unbalance amount of said orbiting member and said bushing.

2. In a fluid displacement apparatus including a housing having a front end plate, a fixed fluid displacement member fixedly disposed relative to said housing, an orbiting fluid displacement member having an end plate from which an orbiting wall extends, said orbiting member interfitting with said fixed member to make a plurality of line contacts to define at least one sealed-off fluid pocket, a drive shaft rotatably supported by said front end plate, a drive pin extending from an inner end of said drive shaft at a location eccentric with respect to the axis of said drive shaft, said end plate of said orbiting member having a boss disposed on one of its side surfaces, a bushing rotatably supported by said boss, said bushing having an eccentric hole located eccentrically with respect to the center of said bushing, and said drive pin being inserted in said eccentric hole and rotatably connected to said bushing whereby said orbiting member is moved in orbital motion by the rotation of said drive shaft, the improvement comprising:

restriction means coupled between said drive shaft and said bushing for restricting the swing angle of said bushing around said drive pin, said restriction means including a projection and an elongate reception opening, said projection extending from one of said bushing and said inner end of said drive shaft, and said elongate reception opening having opposing closed ends and being formed in the other of said bushing and said inner end of said drive shaft, said projection extending into said elongate reception opening, and said restriction means including spring means for urging said orbiting member in a direction to reduce the orbital radius of said orbiting member and to bias said wall of said orbiting member out of contact with said fixed member when said orbiting member is not driven, said spring means including a spring disposed within said elongate reception opening and said projection being movable along substantially the entire length of said elongate reception opening, except for the area occupied by said spring; and said drive shaft having a balance weight at its inner end for canceling unbalance caused by the orbiting motion of said orbiting member and said bushing, and the unbalance amount of said balanceweight being less than the unbalance amount of said orbiting member and said bushing.

3. In a fluid displacement apparatus including a housing having a front end plate, a fixed fluid displacement member fixedly disposed relative to said housing, an orbiting fluid displacement member having an end plate from which an orbiting wall extends, said orbiting member interfitting with said fixed member to make a plurality of line contacts to define at least one sealed-off fluid pocket, a drive shaft rotatably supported by said front end plate, a drive pin extending from an inner end of said drive shaft at a location eccentric with respect to the axis of said drive shaft, said end plate of said orbiting member having a boss disposed on one of its side surfaces, a bushing rotatably supported by said boss, said bushing having an eccentric hole located eccentrically with respect to the center of said bushing, and said drive pin being inserted in said eccentric hole and rotatably connected to said bushing whereby said orbiting member is moved in orbital motion by the rotation of said drive shaft, the improvement comprising:

restriction means coupled between said drive shaft and said bushing for restricting the swing angle of said bushing around said drive pin, said restriction means including a projection and an elongate reception opening, said projection extending from one of said bushing and said inner end of said drive shaft, and said elongate reception opening having opposing closed ends and being formed in the other of said bushing and said inner end of said drive shaft, said projection extending into said elongate reception opening, and said restriction means including spring means for urging said orbiting member in a direction to reduce the orbital radius of said orbiting member and to bias said wall of said orbiting member out of contact with said fixed member when said orbiting member is not driven, said spring means including a spring disposed within said elongate reception opening and said projection beng movable along substantially the entire length of said elongate reception opening, except for the area occupied by said spring; and said bushing having a first balanceweight and said drive shaft having a second balanceweight for canceling the unbalance caused by the orbiting motion of said orbiting member and said bushing, and the total unbalance amount of said first and second balanceweights being less than the unbalance amount of said orbiting member and said bushing.

4. The fluid displacement apparatus of claim 1, 2, or 3 wherein said fixed member includes an end plate from which a spiroidal wall extends, and said wall of said orbiting member having a spiroidal shape.

5. The fluid displacement apparatus of claim 1, 2, or 3 wherein said projection extends from said bushing and said reception opening is formed in said inner end of said drive shaft.

6. The fluid displacement apparatus of claim 5 wherein said fixed member includes an end plate from which a spiroidal wall extends, and said wall of said orbiting member having a spiroidal shape.

* * * * *